US009556395B2

(12) United States Patent
Kashani-Shirazi et al.

(10) Patent No.: US 9,556,395 B2
(45) Date of Patent: Jan. 31, 2017

(54) USE OF POLYALKOXYLATES IN LUBRICANT COMPOSITIONS

(71) Applicant: BASF SE, Ludwigshafen (DE)

(72) Inventors: Nawid Kashani-Shirazi, Mannheim (DE); Muriel Ecormier, Mannheim (DE); Markus Hansch, Speyer (DE); Claudia Fischer, Ludwigshafen (DE); Thomas Weiβ, Ilvesheim (DE)

(73) Assignee: BASF SE (DE)

( * ) Notice: Subject to any disclaimer, the term of this patent is extended or adjusted under 35 U.S.C. 154(b) by 0 days.

(21) Appl. No.: 14/774,040

(22) PCT Filed: Mar. 10, 2014

(86) PCT No.: PCT/EP2014/054556

§ 371 (c)(1),
(2) Date: Sep. 9, 2015

(87) PCT Pub. No.: WO2014/139935

PCT Pub. Date: Sep. 18, 2014

(65) Prior Publication Data

US 2016/0024412 A1 Jan. 28, 2016

(30) Foreign Application Priority Data

Mar. 11, 2013 (EP) ..... 13158648
Mar. 22, 2013 (EP) ..... 13160655

(51) Int. Cl.

*C10M 129/16* (2006.01)
*C10M 145/32* (2006.01)
*C10M 107/34* (2006.01)
*C10M 129/86* (2006.01)

(52) U.S. Cl.

CPC ..... *C10M 129/16* (2013.01); *C10M 107/34* (2013.01); *C10M 129/86* (2013.01); *C10M 145/32* (2013.01); *C10M 2203/1025* (2013.01); *C10M 2205/0285* (2013.01); *C10M 2207/04* (2013.01); *C10M 2209/106* (2013.01); *C10M 2209/1065* (2013.01); *C10N 2230/02* (2013.01); *C10N 2230/06* (2013.01); *C10N 2230/64* (2013.01); *C10N 2230/70* (2013.01); *C10N 2240/04* (2013.01); *C10N 2240/046* (2013.01); *C10N 2240/06* (2013.01); *C10N 2240/10* (2013.01); *C10N 2240/12* (2013.01); *C10N 2240/121* (2013.01); *C10N 2240/201* (2013.01); *C10N 2240/30* (2013.01); *C10N 2240/40* (2013.01); *C10N 2240/404* (2013.01); *C10N 2240/405* (2013.01); *C10N 2240/50* (2013.01); *C10N 2240/58* (2013.01); *C10N 2250/10* (2013.01)

(58) Field of Classification Search

CPC . C10M 129/16; C10M 145/26; C10M 145/32; C10M 2209/103; C10M 2209/1033; C10M 2209/106
USPC ..... 508/579
See application file for complete search history.

(56) References Cited

U.S. PATENT DOCUMENTS

| | | | | |
|---|---|---|---|---|
| 3,149,178 | A | 9/1964 | Hamilton et al. | |
| 3,382,291 | A | 5/1968 | Brennan et al. | |
| 3,742,082 | A | 6/1973 | Brennan et al. | |
| 3,769,363 | A | 10/1973 | Breannan et al. | |
| 4,149,178 | A | 4/1979 | Estes et al. | |
| 4,239,930 | A | 12/1980 | Allphin et al. | |
| 4,367,352 | A | 1/1983 | Watts et al. | |
| 4,413,156 | A | 11/1983 | Watts, Jr. et al. | |
| 4,434,308 | A | 2/1984 | Larkin et al. | |
| 4,434,408 | A | 2/1984 | Baba et al. | |
| 4,910,355 | A | 3/1990 | Shubkin et al. | |
| 4,956,122 | A | 9/1990 | Watts et al. | |
| 5,068,487 | A | 11/1991 | Theriot | |
| 5,135,638 | A | 8/1992 | Miller et al. | |
| 5,246,566 | A | 9/1993 | Miller | |
| 5,362,378 | A | 11/1994 | Borghard et al. | |
| 5,565,086 | A | 10/1996 | Cody et al. | |
| 5,741,946 | A | 4/1998 | Wei | |
| 5,741,947 | A | 4/1998 | Wolf et al. | |
| 6,303,533 | B1 | 10/2001 | Grosch et al. | |
| 6,423,107 | B1 | 7/2002 | Delfort et al. | |
| 7,456,138 | B2 * | 11/2008 | Sherman | C08G 65/2609 508/513 |
| 7,612,024 | B2 * | 11/2009 | Li | C10M 173/025 508/202 |
| 8,334,323 | B2 * | 12/2012 | Varineau | C07C 41/03 106/287.26 |
| 8,883,904 | B2 | 11/2014 | Roth et al. | |
| 8,952,109 | B2 | 2/2015 | Weber et al. | |

(Continued)

FOREIGN PATENT DOCUMENTS

| | | |
|---|---|---|
| EP | 0090444 | 10/1983 |
| EP | 0321302 | 6/1989 |

(Continued)

OTHER PUBLICATIONS

PCT International Preliminary Report on Patentability in PCT/EP2014/054556, issued Sep. 15, 2015, 7 pages.

(Continued)

*Primary Examiner* — Ellen McAvoy

(74) *Attorney, Agent, or Firm* — Drinker Biddle & Reath LLP

(57) ABSTRACT

Provided are polyalkoxylates that are prepared by alkoxylating polytetrahydrofurane with butylene oxide for use in lubricant compositions and/or for reducing friction in a driveline.

21 Claims, No Drawings

(56) References Cited

U.S. PATENT DOCUMENTS

| | | | | |
|---|---|---|---|---|
| 9,039,791 | B2 | 5/2015 | Peretolchin et al. | |
| 9,062,266 | B2 | 6/2015 | Peretolchin et al. | |
| 2009/0088349 | A1* | 4/2009 | Zhao | C10M 105/18 508/185 |
| 2012/0264872 | A1 | 10/2012 | Weiss et al. | |
| 2012/0264879 | A1 | 10/2012 | Weiss et al. | |
| 2013/0098609 | A1 | 4/2013 | Oetter et al. | |
| 2013/0133243 | A1 | 5/2013 | Roger-Gopfert et al. | |
| 2013/0225463 | A1 | 8/2013 | Hansch et al. | |
| 2013/0228332 | A1 | 9/2013 | Maitro-Vogel et al. | |
| 2013/0232858 | A1 | 9/2013 | Strittmatter et al. | |
| 2013/0244917 | A1* | 9/2013 | Obrecht | C10M 169/04 508/444 |
| 2013/0296210 | A1 | 11/2013 | Hansch et al. | |
| 2014/0249063 | A1* | 9/2014 | Greaves | C10M 169/041 508/579 |
| 2015/0113867 | A1* | 4/2015 | Voelkel | C10L 1/1852 44/444 |
| 2015/0159103 | A1 | 6/2015 | Roeger-Goepfert et al. | |
| 2015/0252277 | A1 | 9/2015 | Hansch et al. | |
| 2015/0266808 | A1 | 9/2015 | Hansch et al. | |
| 2015/0275124 | A1* | 10/2015 | Greaves | C10M 169/041 508/579 |
| 2016/0090546 | A1* | 3/2016 | Kashani-Shirazi | C10M 145/32 508/307 |

FOREIGN PATENT DOCUMENTS

| | | |
|---|---|---|
| EP | 0321304 | 6/1989 |
| EP | 0710710 | 5/1996 |
| EP | 1076072 | 2/2001 |
| EP | 0862947 | 4/2003 |
| JP | 2005-097439 | 4/2005 |
| WO | WO-2012/140059 | 10/2012 |
| WO | WO-2012/140064 | 10/2012 |
| WO | WO-2012/177415 | 12/2012 |
| WO | WO-2013/020871 | 2/2013 |
| WO | WO-2013/037647 | 3/2013 |
| WO | WO-2013/057044 | 4/2013 |
| WO | WO-2013/064689 | 5/2013 |
| WO | WO-2013/076006 | 5/2013 |
| WO | WO-2013/087701 | 6/2013 |
| WO | WO-2013/117616 | 8/2013 |
| WO | WO-2013/131800 | 9/2013 |
| WO | WO-2013/131837 | 9/2013 |
| WO | WO-2013/174631 | 11/2013 |
| WO | WO-2014/064151 | 5/2014 |
| WO | WO-2014/139935 | 9/2014 |
| WO | WO-2015/0112031 | 4/2015 |

OTHER PUBLICATIONS

PCT International Search Report in PCT/EP2014/054556, mailed Jul. 3, 2014, 3 pages.

PCT International Written Opinion in PCT/EP2014/054556, mailed Jul. 3, 2014, 6 pages.

* cited by examiner

USE OF POLYALKOXYLATES IN LUBRICANT COMPOSITIONS

CROSS-REFERENCE TO RELATED APPLICATIONS

This application is the National Stage entry of PCT/EP2014/054556, filed on Mar. 10, 2014, which claims priority to European Application Number 13158648.9, filed on Mar. 11, 2013, and European Application Number 13160655.0, filed on Mar. 22, 2013, which are incorporated herein by reference in their entireties.

TECHNICAL FIELD

The presently claimed invention is directed to the use of polyalkoxylates that are prepared by alkoxylating polytetrahydrofurane with butylene oxide in lubricant compositions.

BACKGROUND

Lubricant compositions are used in a variety of industrial applications such as hydraulic oil, air compressor oil, gas compressor oil, gear oil, bearing and circulating system oil, refrigerator compressor oil and steam and gas turbine oils. Conventional lubricant compositions comprise base stocks, co-solvents and additives.

The base stock is in each case selected according to the viscosity that is desired in the envisioned application. Combinations of base stocks of different viscosities, i.e. low and high viscosity respectively, are often used to adjust the needed final viscosity. The co-solvents are used to dissolve polar additives in usually less polar or unpolar base stocks.

The most common additives are antioxidants, detergents, anti-wear additives, metal deactivator, corrosion inhibitors, friction modifiers, extreme-pressure additives, defoamers, anti-foaming agents, viscosity index improvers and demulsifying agents. These additives are used to impart further advantageous properties to the lubricant composition including longer stability and additional protection.

However, after a certain operation time, lubricant compositions have to be replaced due to lubricity loss and/or product degradation. Depending on the machine (engine, gearbox, compressor . . . ) engineering design and the affinity of the lubricant components to adhere to the surface, a certain residue of the lubricant composition (hold-up) remains in the machine, engine, gear etc. it is used in. When being replaced by an unused and possibly different lubricant composition, the used and new lubricants are mixed with each other. Thus, in order to avoid any complications during operation, compatibility between the old and new lubricant is very important.

Depending on their chemical properties a variety of components of lubricant compositions are incompatible with each other, i.e. the mixture of these components leads to oil gelling, phase separation, solidifying or foaming. The oil gelling leads to a dramatic increase of the viscosity which in turn can cause engine problems and can even require the engine to be replaced, if the damage is severe. Hence, when providing novel compounds that are used in lubricant compositions it should always be ensured that these compounds are compatible with compounds that are conventionally used in lubricant compositions.

Besides compatibility with other lubricants, another area of concern is the energy efficiency. The efficiency can be increased if losses are minimized. The losses can be categorized in losses without and with load, their sum being the total losses. Within many parameters which can be influenced by geometry, material etc. lubricant viscosity has a major effect on losses without load, i.e. spilling: Losses with load can be influenced by a low friction coefficient. Thus, at a given viscosity, energy efficiency strongly depends on the friction coefficient of a lubricant.

The friction coefficient can be measured with several methods like Mini-Traction-Machine (MTM), SRV, 2 disc test rig etc. The benefit of a MTM is that one can see the coefficient of friction as an influence of the slide roll ratio. Slide roll ratio describes the difference of the speeds of ball and disc used in the MTM.

U.S. Pat. No. 5,741,947 A describes the copolymerization of cyclic ethers such as polytetrahydrofuran and alkylene oxide in the presence of heteropolyacid catalysts leading to copolymers of random structures. These copolymers are not sufficiently soluble in oils such as mineral oils and polyalphaolefins.

SUMMARY

Thus, it was an objective of the presently claimed invention to provide compounds that show a low friction coefficient and that are compatible with base stocks, in particular base stocks such as mineral oils and polyalphaolefins, which are conventionally used in lubricant compositions for the preparation of lubricant compositions.

Surprisingly, it has been found that polyalkoxylates which are made of a defined pattern of block polymers show a low friction coefficient and are compatible with base stocks that are conventionally used in lubricant compositions such as mineral oils and polyalphaolefins and consequently can be used for the formulation of lubricant compositions.

DETAILED DESCRIPTION

Hence, in one embodiment, the presently claimed invention is directed to the use of polyalkoxylates of the general formula (I)

(I)

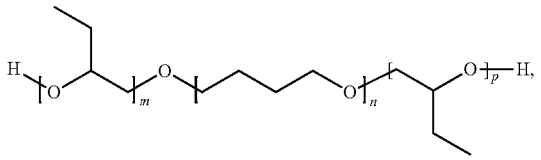

wherein m is an integer in the range of ≥5 to ≤120, p is an integer in the range of ≥5 to ≤120, (m+p) is an integer in the range of ≥10 to ≤240 and n is an integer in the range of ≥2 to ≤30, whereby the ratio of (m+p) to n is in the range of 2.5:1 to 20:1, as lubricants.

By the term of "lubricant", in the sense of the presently claimed invention, is meant a substance capable of reducing friction between moving surfaces.

Thus, in another embodiment, the presently claimed invention is directed to the use of polyalkoxylates of the general formula (I)

(I)

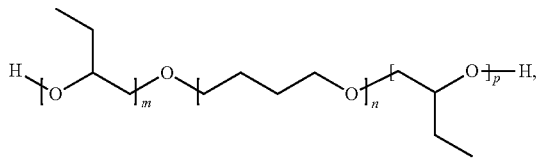

wherein m is an integer in the range of ≥5 to ≤120, p is an integer in the range of ≥5 to ≤120, (m+p) is an integer in the range of ≥10 to ≤240 and n is an integer in the range of ≥2 to ≤30, whereby the ratio of (m+p) to n is in the range of 2.5:1 to 20:1, for reducing friction between metal surfaces.

Polyalkoxylates of general formula (I) are described in EP 1 076 072 A1. However, this patent application is entirely silent about using polyalkoxylates as lubricants.

The polyalkoxylates of general formula (I) are oil soluble, which means that, when mixed with mineral oils and/or polyalphaolefins in a weight ratio of 10:90, 50:50 and 90:10, the polyalkoxylates of general formula (I) do not show phase separation after standing for 24 hours at room temperature for at least two weight rations out of the three weight ratios 10:90, 50:50 and 90:10.

Preferably m is an integer in the range of ≥7 to ≤35, p is an integer in the range of ≥7 to ≤35 and (m+p) is an integer in the range of ≥15 to ≤65. More preferably m is an integer in the range of ≥10 to ≤30, p is an integer in the range of ≥10 to ≤30 and (m+p) is an integer in the range of ≥20 to ≤60.

Preferably the ratio of (m+p) to n is in the range of 3:1 to 20:1, more preferably in the range of 5:1 to 20:1.

Preferably n is an integer in the range of ≥3 to ≤20, more preferably n is an integer in the range of ≥3 to ≤15, most preferably in the range of ≥4 to ≤10.

Preferably the polyalkoxylate of general formula (I) has a weight average molecular weight Mw in the range of 900 to 20000 g/mol, more preferably in the range of 2000 to 10000 g/mol, most preferably in the range of 2000 to 6000 g/mol determined according to DIN55672-1.

In a preferred embodiment, the presently claimed invention is directed to the use polyalkoxylates of the general formula (I)

(I)

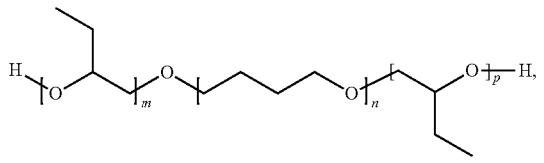

wherein m is an integer in the range of ≥7 to ≤35, p is an integer in the range of ≥7 to ≤35, (m+p) is an integer in the range of ≥15 to ≤65 and n is an integer in the range of ≥3 to ≤15, whereby the ratio of (m+p) to n is in the range of 4:1 to 20:1, as lubricants.

In another embodiment, the presently claimed invention is directed to the use of a mixture of polyalkoxylates of general formula (I), whereby the individual isomers differ in their molecular weight, as lubricant.

In another embodiment, the presently claimed invention is directed to the use of polyalkoxylates of general formula (I) which are obtained by reacting at least one compound of general formula (II)

(II)

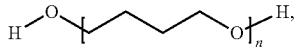

wherein n has the meaning as defined above, with butylene oxide in the presence of at least one catalyst.

Preferably the at least one catalyst is a base or a double metal cyanide catalyst (DMC catalyst). More preferably the at least one catalyst is selected from the group consisting of alkaline earth metal hydroxides such as calcium hydroxide, strontium hydroxide and barium hydroxide and alkali metal hydroxides such as lithium hydroxide, sodium hydroxide, potassium hydroxide, rubidium hydroxide and caesium hydroxide. Most preferably the at least one catalyst is sodium hydroxide.

In case the catalyst is a base, any inert solvents capable of dissolving the polyalkoxylates of general formula (I) and compounds of general formula (II) may be used as solvents during the reaction or as solvents required for working up the reaction mixture in cases where the reaction is carried out without solvents. The following solvents are mentioned as examples: methylene chloride, trichloroethylene, tetrahydrofuran, dioxane, methyl ethyl ketone, methylisobutyl ketone, ethyl acetate and isobutyl acetate.

In case the catalyst is a base, the amount of catalysts used is preferably in the range from 0.01 to 1.0, more preferably in the range from 0.05 to 0.5, % by weight, based on the total amount of the end materials. The reaction is preferably carried out at a temperature in the range of 70 to 200° C., more preferably from 100 to 160° C. The pressure is preferably in the range from 1 bar to 150 bar, more preferably in the range from 3 to 30 bar.

In case a DMC catalyst is used, it is in principle possible to use all types of DMC catalysts known from the prior art. Preference is given to using double metal cyanide catalysts of the general formula (1):

$$M^1_a[M^2(CN)_b(A)_c]_d.fM^1gX_n.h(H_2O).eL, \quad (1)$$

wherein $M^1$ is a metal ion selected from the group comprising $Zn^{2+}$, $Fe^{2+}$, $Co^{3+}$, $Ni^{2+}$, $Mn^{2+}$, $Co^{2+}$, $Sn^{2+}$, $Pb^{2+}$, $Mo^{4+}$, $Mo^{6+}$, $Al^{3+}$, $V^{4+}$, $V^{5+}$, $Sr^{2+}$, $V^{5+}$, $Cr^{2+}$, $Cr^{3+}$ and $Cd^{2+}$, $M^2$ is a metal ion selected from the group comprising $Fe^{2+}$, $Fe^{3+}$, $Co^{2+}$, $Co^{3+}$, $Mn^{2+}$, $Mn^{3+}$, $V^{4+}$, $V^{5+}$, $Cr^{2+}$, $Cr^{3+}$, $Rh^{3+}$, $Ru^{2+}$ and $Ir^{3+}$, $M^1$ and $M^2$ are identical or different, A is an anion selected from the group comprising halide, hydroxide, sulfate, carbonate, cyanide, thiocyanate, isocyanate, cyanate, carboxylate, oxalate and nitrate, X is an anion selected from the group comprising halide, hydroxide, sulfate, carbonate, cyanide, thiocyanate, isocyanate, cyanate, carboxylate, oxalate and nitrate, L is a water-miscible ligand selected from the group comprising alcohols, aldehydes, ketones, ethers, poly-ethers, esters, ureas, amides, nitriles and sulfides, and a, b, c, d, g and n are selected so that the compound is electrically neutral and e is the coordination number of the ligand or zero, f is a fraction or integer greater than or equal to zero, h is a fraction or integer greater than or equal to zero.

Such compounds are generally known and can be prepared, for example, by the process described in EP-B1-0862 947 by combining the aqueous solution of a water-soluble metal salt with the aqueous solution of a hexacyanometallate compound, in particular of a salt or an acid, and, if necessary, adding a water-soluble ligand thereto either during or after the combination of the two solutions.

DMC catalysts are usually prepared as a solid and used as such. The catalyst is typically used as powder or in suspension. However, other ways known to those skilled in the art for using catalysts can likewise be employed. In a preferred embodiment, the DMC catalyst is dispersed with an inert or non-inert suspension medium which can be, for example, the product to be produced or an intermediate by suitable measures, e.g. milling. The suspension produced in this way is used, if appropriate after removal of interfering amounts of water by methods known to those skilled in the art, e.g. stripping with or without use of inert gases such as nitrogen and/or noble gases. Suitable suspension media are, for example, toluene, xylene, tetrahydrofuran, acetone, 2-methylpentanone, cyclohexanone and also polyether alcohols according to the invention and mixtures thereof. The catalyst is preferably used in a suspension in a polyol as described, for example, in EP-A-0 090 444.

In another embodiment, the presently claimed invention is directed to the use of at least one polyalkoxylate of general formula (I) as defined above or a mixture of polyalkoxylates of general formula (I) as defined above for the preparation of a lubricant composition.

In another embodiment, the presently claimed invention is directed to a lubricant composition comprising at least one polyalkoxylate of general formula (I) as defined above or a mixture of polyalkoxylates of general formula (I) as defined above. Preferably, the lubricant composition according to the presently claimed invention has a friction coefficient in the range of 0.003 to 0.030 at 25% slide roll ratio (SRR) determined using mini-traction machine (MTM) measurements at 70° C. and 1 GPa.

In another embodiment, the presently claimed invention is directed to a driveline oil comprising at least one polyalkoxylate of general formula (I) as defined above or a mixture of polyalkoxylates of general formula (I) as defined above.

In another embodiment, the presently claimed invention relates to an industrial oil comprising at least one polyalkoxylate of general formula (I) as defined above or a mixture of polyalkoxylates of general formula (I) as defined above.

Lubricant compositions and industrial oils comprising at least one polyalkoxylate of general formula (I) as defined above or a mixture of polyalkoxylates of general formula (I) as defined above can be used for various applications such as light, medium and heavy duty engine oils, industrial engine oils, marine engine oils, automotive engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, moulding fluids, gun, pistol and rifle lubricants or watch lubricants and food grade approved lubricants.

A lubricant composition comprises base stocks and a variety of different additives.

The presently claimed invention is also directed to a lubricant composition comprising a) ≥1% to ≤99% by weight of at least one polyalkoxylate of general formula (I) as defined above, b) ≥1% to ≤99% by weight of at least one base stock selected from the group consisting of mineral oils (Group I, II or III oils), polyalphaoiefins (Group IV oils), polymerized and interpolymerized olefins, alkyl naphthalenes, alkylene oxide polymers, silicone oils, phosphate esters and carboxylic acid esters (Group V oils), and c) ≥1.0 to ≤25% by weight of one or more additives, whereby the % by weight of the components a), b) and c) is in each case related to the overall weight of the lubricant composition and the sum of the weight of all components a), b) and c) adds up to 100%.

The presently claimed invention is also directed to a lubricant composition comprising a) ≥1% to ≤99% by weight of at least one polyalkoxylate of general formula (I) as defined above, b) ≥1% to ≤99% by weight of at least one base stock selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils), and c) ≥1.0 to ≤25% by weight of one or more additives selected from the group consisting of dispersants, metal deactivators, detergents, viscosity modifiers, extreme pressure agents (typically boron- and/or sulfur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents and friction modifiers, whereby the % by weight of the components a), b) and c) is in each case related to the overall weight of the lubricant composition and the sum of the weight of all components a), b) and c) adds up to 100%.

Preferably, the presently claimed invention is also directed to a lubricant composition comprising a) ≥1% to ≤10% by weight of at least one polyalkoxylate of general formula (I) as defined above, b) ≥10% to ≤90% by weight of at least one base stock selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils), and c) ≥1.0 to ≤25% by weight of one or more additives selected from the group consisting of dispersants, metal deactivators, detergents, viscosity modifiers, extreme pressure agents (typically boron- and/or sulfur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents and friction modifiers, whereby the % by weight of the components a), b) and c) is in each case related to the overall weight of the lubricant composition and the sum of the weight of all components a), b) and c) adds up to 100%.

Preferably, the presently claimed invention is also directed to a lubricant composition comprising a) ≥20% to ≤80% by weight of at least one polyalkoxylate of general formula (I) as defined above, b) ≥20% to ≤80% by weight of at least one base stock selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils), and c) ≥1.0 to ≤25% by weight of one or more additives selected from the group consisting of dispersants, metal deactivators, detergents, viscosity modifiers, extreme pressure agents (typically boron- and/or sulfur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents and friction modifiers, whereby the % by weight of the components a), b) and c) is in each case related to the overall weight of the lubricant composition and the sum of the weight of all components a), b) and c) adds up to 100%.

Preferably, the presently claimed invention is also directed to a lubricant composition comprising a) ≥40% to ≤60% by weight of at least one polyalkoxylate of general formula (I) as defined above, b) ≥40% to ≤60% by weight of at least one base stock selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils), and c) ≥1.0 to ≤25% by weight of one or more additives selected from the group consisting of dispersants, metal deactivators, detergents, viscosity modifiers, extreme pressure agents (typically boron- and/or sulfur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents and friction modifiers, whereby the % by weight of the components a), b) and c) is in each case related to the overall weight of the lubricant composition and the sum of the weight of all components a), b) and c) adds up to 100%.

Base stocks are of synthetic or of mineral oil origin.

Synthetic lower viscosity fluids suitable for the present invention include the polyalphaolefins (PAOs) and the synthetic oils from the hydrocracking or hydroisomerization of Fischer Tropsch high boiling fractions including waxes. These are both stocks comprised of saturates with low impurity levels consistent with their synthetic origin. The hydroisomerized Fischer Tropsch waxes are highly suitable base stocks, comprising saturated components of iso-paraffinic character (resulting from the isomerization of the predominantly n-paraffins of the Fischer Tropsch waxes) which give a good blend of high viscosity index and low pour point. Processes for the hydroisomerization of Fischer Tropsch waxes are described in U.S. Pat. Nos. 5,362,378; 5,565,086; 5,246,566 and 5,135,638, as well in EP 710710, EP 321302 and EP 321304.

Polyalphaolefins suitable for the present invention, as either lower viscosity or high viscosity fluids depending on their specific properties, include known PAO materials which typically comprise relatively low molecularweight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-octene, poly-1-decene, and poly-1-dodecene, although the dimers of higher olefins in the range of $C_{14}$ to $C_{18}$ provide low viscosity base stocks.

Low viscosity PAO fluids suitable for the present invention, may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example, the methods disclosed by U.S. Pat. No. 3,149,178 or 3,382,291 may be conveniently used herein. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,308 (Larkin); U.S. Pat. No. 4,910,355 (Shubkin); U.S. Pat. No. 4,956,122 (Watts); and U.S. Pat. No. 5,068,487 (Theriot).

The lubricant composition of the presently claimed invention may further comprise esters.

Esters suitable for the present invention include the esters of mono and polybasic acids with monoalkanols (simple esters) or with mixtures of mono and polyalkanols (complex esters), and the polyol esters of monocarboxylic acids (simple esters), or mixtures of mono and polycarboxylic acids (complex esters). Esters of the mono/polybasic type include, for example, the esters of monocarboxylic acids such as heptanoic acid, and dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, or mixtures thereof with polyalkanols, etc. Specific examples of these types of esters include nonyl heptanoate, dibutyl adipate, di(2-ethylhexyl) sebacate, di-n-hexyl fumarate, dioctyl sebacatediisooctyl azelate, diisodecyl azelate, dioctyl phthalate, didecyl phthalate, dieicosyl sebacate, dibutyl-TMP-adipate, etc.

Also suitable for the present invention are esters, such as those obtained by reacting one or more polyhydric alcohols, preferably the hindered polyols such as the neopentyl polyols, e.g. neopentyl glycol, trimethylol ethane, 2-methyl-2-propyl-1,3-propanediol, trimethylol propane, trimethylol butane, pentaerythritol and dipentaerythritol with monocarboxylic acids containing at least 4 carbons, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures thereof, with polycarboxylic acids.

The lubricant composition preferably also comprises other types of additives in the range between 0.1 to 30%, more preferably in the range between 0.5 to 20%, most preferably in the range of between 1 to 10% by weight, related to the total weight of the lubricant composition. The additives are selected from the group consisting of detergents, dispersants, antioxidants, friction modifiers, corrosion inhibitors, rust inhibitors, anti-wear additives, foam depressants, pour point depressants, viscosity index improvers and mixtures thereof.

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10.000 to 300.000, and alpha-olefin polymers or alpha-olefin copolymers having a number average molecular weight of 1.000 to 30.000, particularly ethylene-alpha-olefin copolymers having a number average molecular weight of 1.000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20% by weight, in relation to the weight of the base stock.

Pour point depressants (PPD) include polymethacrylates. Commonly used additives such as alkylaromatic polymers and polymethacrylates are useful for this purpose; typically the treat rates range from 0.001% to 1.0% by weight, in relation to the weight of the base stock.

Foam depressants include polymers of alkyl methacrylate especially useful poly alkyl acrylate polymers, where alkyl is generally understood to be methyl, ethyl propyl, isopropyl, butyl, or iso butyl and polymers of dimethylsilicone which form materials called polydimethylsiloxane polymers. Other additives are foam depressants, such as silicone polymers which have been post reacted with various carbon containing moieties.

Detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1% by weight in relation to the weight of the base stock; these can also be high TBN, low TBN, or mixtures of highlow TBN.

Antiwear additives include ZDDP (zinc dialkyithiophosphates), ashless and ash containing organic phosphorous and organo-sulphur compounds, boron compounds, and organomolybdenum compounds.

Ash-containing dispersants include neutral and basic alkaline earth metal salts of an acidic organic compound.

Oxidation stability may be enhanced in the lubricating compositions of the present invention by the use of antioxidants and for this purpose a wide range of commercially available materials is suitable. The most common types of antioxidants suitable for use in the present invention are the phenolic antioxidants, the amine type antioxidants, the alkyl aromatic sulfides, phosphorus compounds such as the phosphites and phosphonic acid esters and the sulfur-phosphorus compounds such as the dithiophosphates and other types such as the dialkyl dithiocarbamates, e.g., methylene bis(di-n-butyl) dithiocarbamate. They may be used individually by type or in combination with one another. Mixtures of different types of phenols or amines are particularly useful. Preferably, the total amount of antioxidant will not exceed 10% by weight of the total lubricant composition and more preferably will be less, for example below 5% by weight of the total composition. Most preferably, from 0.5 to 2% by weight of the total composition of an antioxidant is suitable, although for certain applications more may be used if desired.

Rust inhibitors include alkenyl succinic acids, partial esters thereof and nitrogen-containing derivatives thereof; and synthetic alkarylsulfonates, such as metal dinonylnaphthalene sulfonates. Rust inhibitors include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

More particularly preferred rust inhibitors are indicated below. Examples of monocarboxylic acids ($C_8$-$C_{30}$), caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated ($C_8$-$C_{20}$) phenoxyacetic acids, lanolin fatty acid and $C_8$-$C_{24}$ mercapto-fatty acids.

Examples of the alkylamines which function as rust inhibitors or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine.

Corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurised in an amount up to 35% by weight. Preferably, the acid is a $C_4$ to $C_{22}$ straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid. A component of the anti-corrosion combination is a triazole. The triazole should be used at a concentration from 0.005%> to 0.25% by weight of the total composition. Further examples include triazole, benzotriazole and substituted benzotriazoles such as alkyl substituted derivatives. The alkyl substituent generally contains up to 2 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred.

In another embodiment, the presently claimed invention is directed to a method of reducing friction in an engine using an engine oil comprising at least one polyalkoxylate as defined above.

In another embodiment, the presently claimed invention is directed to a method of reducing friction in a driveline using a driveline oil comprising at least one polyalkoxylate as defined above.

EXAMPLES

Synthesis of the Polyalkylene Glycols

Example 1

PolyTHF 250 with 20 BuO

A steel reactor (1.5 l) was loaded with polytetrahydrofurane (MW 250) (0.6 mol, 150 g), and 4 g KOH (50%) was mixed and the reactor was purged with nitrogen. The reactor was heated under vacuum (10 mbar) and heated to 100° C. for 2 h. Then again nitrogen was loaded. At a pressure of 2 bar 50 g butylene oxide was brought in dropwise at 140° C. 816 g butylene oxide of total (866 g; 12.8 mol) was added during 7 h at 140° C. and under pressure of 6 bar. The reactor was cooled to 80° C. and the product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 983.8 g, 96.8% Th. (1016 g)

Example 2

PolyTHF 250 with 32 BuO

A steel reactor (1.5 l) was loaded with polytetrahydrofurane (MW 250) (0.4 mol, 100 g), and 4 g KOH (50%) was mixed and the reactor was purged with nitrogen. The reactor was heated under vacuum (10 mbar) and heated to 100° C. for 2 h. Then again nitrogen was loaded. At a pressure of 2 bar 50 g butylene oxide was brought in dropwise at 140° C. 816 g butylene oxide of total (866 g; 12.8 mol) was added during 7 h at 140° C. and under pressure of 6 bar. There reactor was cooled to 80° C. and the product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 919.5 g, 95.2% Th. (966 g)

Example 3

PolyTHF 250 with 55 BuO

A steel reactor (1.5 l) was loaded with polytetrahydrofurane (MW 250) (0.24 mol, 60 g), and 4.1 g KOH (50%) was mixed and the reactor was purged with nitrogen. The reactor was heated under vacuum (10 mbar) and heated to 100° C. for 2 h. Then again nitrogen was loaded. At a pressure of 2 bar 50 g butylene oxide was brought in dropwise at 140° C. 911 g butylene oxide of total (951 g; 13.2 mol) was added during 7 h at 140° C. and under pressure of 6 bar. There reactor was cooled to 80° C. and the product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 952.5 g, 94.2% Th. (1011 g)

Example 4

Mixture of PolyTHF 250 and PolyTHF 650 with 50 BuO

A steel reactor (1.5 l) was loaded with a 50 mol %-mixture of polytetrahydrofuranes (MW 250 MW 650) (total 0.28 mol, 126 g), 4.5 g KOH (50%) were added and the reactor was purged with nitrogen. The reactor was heated under vacuum (10 mbar) and heated to 100° C. for 2 h. Then again nitrogen was loaded. At a pressure of 2 bar 50 g butylene oxide was brought in dropwise at 140° C. 936 g butylene oxide of total (1008 g; 14 mol) were added during 7 h at 140° C. and under pressure of 6 bar. The reactor was cooled to 80° C. and the product was stripped by nitrogen. Then the product was discharged and mixed with Ambosol® (magnesium silicate, 30 g) and mixed on a rotary evaporator at 80° C. The purified product was obtained by fitration in a pressure strainer (Filtration media: Seitz 900). Yield: 1084 g, 95.6% Th. (1134 g)

Example 11

Poly(Co-Tetrahydrofuran-Co-Butylene Oxide)

A steel reactor (2.5 l) was loaded with tetrahydrofuran (222 g; 3.1 mol), and 1.5 g phosphotungstic acid ($H_3PW_{12}O_{40}.10\ H_2O$, dried in vacuum). The reactor was purged with nitrogen. The reactor was heated under vacuum (10 mbar) and heated to 100° C. for 2 h. The reaction mixture was heated to 120° C. and at a pressure of 2 bar butylene oxide (222 g, 3.1 mol) was brought in dropwise within 3 h at 120° C. The reaction mixture was stirred at 120° C. for 10 h. The reactor was cooled to 80° C. and the product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 300 g, 67% Th.

Example 12

Poly(Co-Tetrahydrofuran-Co-Butylene Oxide)

A steel reactor (2.5 l) was loaded with tetrahydrofuran (72 g; 1.0 mol), and 2.5 g phosphotungstic acid ($H_3PW_{12}O_{40}$·10 $H_2O$, dried in vacuum). The reactor was purged with nitrogen. The reactor was heated under vacuum (10 mbar) and heated to 100° C. for 2 h. The reaction mixture was heated to 120° C. and at a pressure of 2 bar butylene oxide (742 g, 10.3 mol) was brought in dropwise within 12 h at 120° C. The reaction mixture was stirred at 120° C. for 10 h. The reactor was cooled to 80° C. and the product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 753 g, 92.3% Th.

TABLE 1

Analytics: Examples:

| | Starting Alkohol | BuO | OHZ [mg KOH/g] | Mn | Mw | PD |
|---|---|---|---|---|---|---|
| Exp. 1 | pTHF-250 | 20 | 55.2 | 2016 | 2140 | 1.06 |
| Exp. 2 | pTHF-250 | 30 | 42.2 | 2922 | 3072 | 1.05 |
| Exp. 3 | pTHF-250 | 55 | 20.1 | 5021 | 5211 | 1.04 |
| Exp. 4 | pTHF-250 and pTHF-650 | 50 | n.d. | 4205 | 4418 | 1.05 |
| Exp. 11 | — | — | — | 2778 | 4443 | — |
| Exp. 12 | — | — | 68.2 | 962 | 2663 | — |

OHZ = hydroxyl number, determined according to DIN 53240

Mn = number average molecular weight, determined according to DIN55672-1 and referred to Polystyrene calibration standard.

Mw = weight average molecular weight, determined according to DIN55672-1 and referred to Polystyrene calibration standard.

PD = polydispersity

Measuring Physical Properties

The kinematic viscosity was measured according to the standard international method ASTM D 445.

The viscosity index was measured according to the ASTM D 2270.

The pour point according was measured to DIN ISO 3016.

Friction Coefficient Evaluation

The fluids were tested in the MTM (Mini-Traction Machine) instrument using the so-called traction test mode. In this mode, the friction coefficient is measured at a constant mean speed over a range of slide roll ratios (SRR) to give the traction curve. SRR=sliding speed/mean entrainment speed=2 (U1−U2)/(U1+U2) in which U1 and U2 are the ball and disc speeds respectively The disc and ball used for the experiments were made of steel (AISI 52100), with a hardness of 750 HV and Ra<0.02 μm. The diameter was 45.0 mm and 19.0 mm for the disc and the ball respectively. The tractions curves were run with 1.00 GPa contact pressure, 4 m/s mean speed and 70° C. temperature. The conditions were set high to mimic the harsh pressure and sliding conditions which could be observed in worm gear applications. The slide-roll ratio (SRR) was varied from 0 to 25% and the friction coefficient measured. Each sample was run three times. The ball and disc were examined using an optical microscope at the end of the test. The wear marks were rated as follows (from low to high wear): zero wear> a few wear marks> significant wear. The wear scar was measured when significant wear was observed. The wear scar values are quoted for the ball and disc respectively in μm.

Oil Compatibility Evaluation

A method was developed in-house to determine oil compatibility. The oil and test material were mixed in 10/90, 50/50 and 90/10 w/w ratios respectively. The mixtures were mixed at room temperature by rolling for 12 hours. The mixtures' appearance was observed after homogenization and again after 24 hours. The test material is deemed compatible with the oil when no phase separation is observed after 24 hours for at least two of the ratios investigated.

TABLE 2

| | Structure/Sample | Kinematic viscosity ($mm^2/s$) 40° C. | 100° C. | Viscosity Index | Pour point (° C.) | MTM friction coefficient at 25% SRR |
|---|---|---|---|---|---|---|
| Example 1 | pTHF250 + 20 BO | 169 | 21 | 146 | −36 | 0.030 |
| Example 2 | pTHF250 + 30 BO | 257 | 30 | 158 | −39 | 0.029 |
| Example 3 | pTHF250 + 55 BO | 492 | 56 | 180 | −36 | 0.028 |
| Example 4 | pTHF450 + 50 BO | 388 | 45 | 174 | −36 | 0.027 |
| Example 5* | polybutylene glycol (propandiol + 43 BO) | 304 | 35 | 159 | −39 | 0.034 |
| Example 6* | p-THF 1000 + 20 PO | 348 | 50 | 207 | −9 | 0.013 |
| Example 7* | p-THF 1000 + 10 PO + 13 EO | 359 | 57 | 227 | −6 | 0.008 |
| Example 8* | p-THF 250 | 54 | 7 | 94 | −42 | 0.007 |
| Example 9* | p-THF 650 | 159 | 22 | 165 | 3 | 0.007 |
| Example 10* | p-THF 1000 | 291 | 40 | 193 | 6 | 0.007 |
| Example 11* | THF + BO (1:1) | 203 | 28 | 175 | −48 | 0.013 |
| Example 12* | THF + BO (1:10.3) | 95 | 14 | 157 | −51 | 0.020 |

pTHF = polytetrahydrofuran,

BO = butylene oxide,

PO = propylene oxide,

EO = ethylene oxide

*comparative examples

TABLE 3

| | Mineral oil Group III compatibility at room temperature (oil/test material) | | | Low viscosity PAO compatibility at room temperature (oil/test material) | | |
|---|---|---|---|---|---|---|
| | 10/90 | 50/50 | 90/10 | 10/90 | 50/50 | 90/10 |
| Example 1 | Yes | No | Yes | Yes | Yes | Yes |
| Example 2 | Yes | Yes | Yes | Yes | Yes | Yes |
| Example 3 | Yes | Yes | Yes | Yes | Yes | Yes |
| Example 4 | Yes | No | Yes | Yes | Yes | Yes |
| Example 5* | Yes | Yes | Yes | No | No | No |
| Example 6* | No | No | No | No | No | No |
| Example 7* | No | No | No | No | No | No |
| Example 8* | No | No | No | No | No | No |
| Example 9* | No | No | No | No | No | No |
| Example 10* | No | No | No | No | No | No |
| Example 11* | No | No | No | No | No | Yes |
| Example 12* | No | No | Yes | No | No | Yes |

*comparative examples

The oil compatibility and friction data are summarized in Tables 2 and 3. The data demonstrate that the molecules derived from the present invention, namely polyalkylene glycols produced from the alkoxylation of polytetrahydrofuran (pTHF) with butylene oxide show compatibility with mineral oils and low viscosity polyalphaolefins whilst providing low friction coefficients (≤0.030 at 25% SRR in MTM experiments).

By contrast, comparative examples 6, 7, 8, 9 and 10 exhibit low friction coefficient (≤0.015 at 25% SRR in MTM experiments) but prove to be completely incompatible with mineral oils or polyalphaolefins. Comparison of Examples 1, 2 and 3 with comparative example 8 demonstrates the marked improvement in oil compatibility upon alkoxylation with butylene oxide whilst maintaining a low friction coefficient.

Oil compatible materials presented in Examples 1 to 4 exhibit friction coefficient equal or lower than 0.030 at 25% SRR in the MTM experiments. Polyalkylene glycols presented in comparative example 5 are proven to be compatible with at least mineral oil (Example 6 was not compatible with low viscosity polyalphaolefins) but exhibit friction coefficients at least 13% and 26% higher compared to Example 1 and Example 4 respectively.

Comparison of Examples 1 to 4 with comparative example 5 demonstrates a significant decrease in MTM friction coefficient whilst showing equal and in some instances improved oil compatibility.

Comparison of Examples 1 to 4 with comparative examples 11 and 12 demonstrates a similar MTM friction coefficient. However, the random copolymers made of tetrahydrofuran and butylene oxide are not compatible with oil.

The invention claimed is:

1. A method of making a lubricant composition, the method comprising obtaining at least one polyalkoxylate of the general formula (I)

(I)

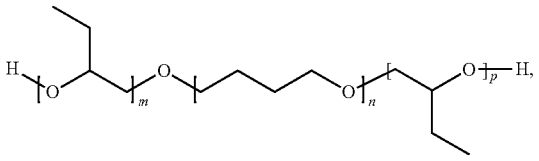

wherein m is an integer in the range of ≥5 to ≤120, p is an integer in the range of ≥5 to ≤120, (m+p) is an integer in the range of ≥10 to ≤240 and n is an integer in the range of ≥2 to ≤30, whereby the ratio of (m+p) to n is in the range of 2.5:1 to 20:1, and as lubricant optionally adding one or more basestocks or additives to the polyakoxylate to form the lubricant composition.

2. The method of claim 1, wherein m is an integer in the range of ≥7 to ≤35, p is an integer in the range of ≥7 to ≤35 and (m+p) is an integer in the range of ≥15 to ≤65.

3. The method of claim 1, wherein the ratio of (m+p) to n is in the range of 3:1 to 20:1.

4. The method of claim 1, wherein n is an integer in the range of ≥3 to ≤20.

5. The method of claim 1, wherein the polyalkoxylate has a weight average molecular weight Mw in the range of 900 to 20000 g/mol determined according to DIN55672-1 (polystyrene calibration standard).

6. The method of claim 1, wherein the polyalkoxylate of the general formula (I) is obtained by reacting one compound of general formula (II)

(II)

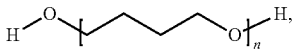

wherein n has the meaning according to one or more of claims 1 to 4, with butylene oxide in the presence of at least one catalyst.

7. The method according to claim 6, wherein the at least one catalyst is a base or a double metal cyanide catalyst.

8. The method of claim 1 further comprising adding the one or more basestocks or the additives to the polyakoxylate to form the lubricant composition.

9. The method of claim 1, wherein the ratio of (m+p) is an integer in the range of ≥20 to ≤60.

10. A method of reducing friction in a driveline using a driveline oil, the method comprising obtaining a lubricant comprising at least one polyalkoxylate of the general formula (I)

(I)

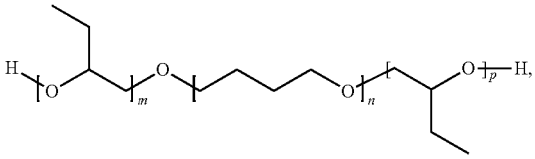

wherein m is an integer in the range of ≥5 to ≤120, p is an integer in the range of ≥5 to ≤120, (m+p) is an integer in the range of ≥10 to ≤240 and n is an integer in the range of ≥2 to ≤30, whereby the ratio of (m+p) to n is in the range of 2.5:1 to 20:1, and putting the lubricant in the driveline for reducing friction between metal surfaces.

11. The method of claim 10, wherein m is an integer in the range of ≥7 to ≤35, p is an integer in the range of ≥7 to ≤35 and (m+p) is an integer in the range of ≥15 to ≤65.

12. The method of claim 10, wherein the ratio of (m+p) to n is in the range of 3:1 to 20:1.

13. The method of claim 10, wherein n is an integer in the range of ≥3 to ≤20.

14. The method of claim 10, wherein the polyalkoxylate has a weight average molecular weight Mw in the range of 900 to 20000 g/mol determined according to DIN55672-1 (polystyrene calibration standard).

15. The method of claim 10, wherein the polyalkoxylate of the general formula (I) is obtained by reacting one compound of general formula (II)

(II)

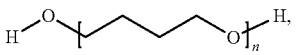

wherein n has the meaning according to one or more of claims 1 to 4, with butylene oxide in the presence of at least one catalyst.

16. The method according to claim 15, wherein the at least one catalyst is a base or a double metal cyanide catalyst.

17. A lubricant composition comprising at least one polyalkoxylate of general formula (I)

(I)

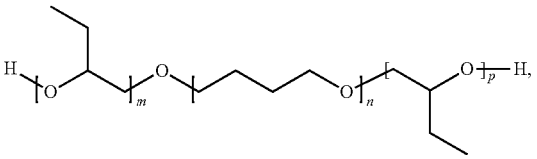

wherein m is an integer in the range of ≥5 to ≤120, p is an integer in the range of ≥5 to ≤120, (m+p) is an integer in the range of ≥10 to ≤240 and n is an integer in the range of ≥2 to ≤30, whereby the ratio of (m+p) to n is in the range of 2.5:1 to 20:1.

18. The lubricant composition according to claim 17 further comprising at least one base stock selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils), and one or more additives.

19. The lubricant composition according to claim 17 which is effective for light, medium and heavy duty engine oils, industrial engine oils, marine engine oils, automotive engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, moulding fluids, gun, pistol and rifle lubricants or watch lubricants or food grade approved lubricants.

20. The lubricant composition of claim 17, wherein the ratio of (m+p) is an integer in the range of ≥20 to ≤60 and n is an integer in the range of ≥4 to ≤10.

21. The lubricant composition of claim 17, wherein the polyalkoxylate has a weight average molecular weight Mw in the range of 2000 to 6000 g/mol determined according to DIN55672-1 (polystyrene calibration standard).

* * * * *